US008318025B2

(12) United States Patent
Domke et al.

(10) Patent No.: US 8,318,025 B2
(45) Date of Patent: Nov. 27, 2012

(54) PROCESSING RICH ORES USING MAGNETIC PARTICLES

(75) Inventors: Imme Domke, Mannheim (DE); Norbert Mronga, Dossenheim (DE); Alexej Michailovski, Mannheim (DE); Hartmut Hibst, Schriesheim (DE); Thomas Servay, Heidelberg (DE); Rainer Klopsch, Worms (DE)

(73) Assignee: BASF SE, Ludwigshafen (DE)

( * ) Notice: Subject to any disclaimer, the term of this patent is extended or adjusted under 35 U.S.C. 154(b) by 476 days.

(21) Appl. No.: 12/675,836

(22) PCT Filed: Sep. 1, 2008

(86) PCT No.: PCT/EP2008/061503

§ 371 (c)(1),
(2), (4) Date: Apr. 16, 2010

(87) PCT Pub. No.: WO2009/030669

PCT Pub. Date: Mar. 12, 2009

(65) Prior Publication Data

US 2010/0300941 A1 Dec. 2, 2010

(30) Foreign Application Priority Data

Sep. 3, 2007 (EP) ..... 07115542

(51) Int. Cl.
*B03C 1/023* (2006.01)

(52) U.S. Cl. ..... 210/695; 210/679; 210/714; 210/724; 210/222; 209/5; 209/8; 209/9; 209/39; 209/214

(58) Field of Classification Search ..... 210/679, 210/695, 714, 724, 222; 209/5, 8, 9, 39, 209/214

See application file for complete search history.

(56) References Cited

U.S. PATENT DOCUMENTS

| | | | |
|---|---|---|---|
| 4,094,804 | A | 6/1978 | Shimoiizaka |
| 4,657,666 | A | 4/1987 | Snook et al. |
| 4,834,898 | A | 5/1989 | Hwang |
| 4,906,382 | A | 3/1990 | Hwang |
| 5,043,979 | A | 8/1991 | Sakurai et al. |
| 5,161,694 | A | 11/1992 | Yoon et al. |
| 2004/0096511 | A1 | 5/2004 | Harburn et al. |

FOREIGN PATENT DOCUMENTS

| | | | |
|---|---|---|---|
| DE | 235791 | A3 | 5/1986 |
| DE | 3709852 | A1 | 10/1988 |
| DE | 19758335 | C1 | 3/1999 |
| JP | 56118496 | A | 9/1981 |
| WO | 02066168 | A1 | 8/2002 |
| WO | 2007008322 | A | 1/2007 |

OTHER PUBLICATIONS

Translation of the International Preliminary Report on Patentability for PCT/EP2008/061503, Jun. 29, 2010.*

Counterpart International Search Report PCT/EP2008/061503, Feb. 24, 2009.

Gray, S.R.; Langberg, D; Gray, N.G., Publications of the Australasian Institut of Mining and Metallurgy, "Recovery of Fine Gold Particles by Flocculation with Hydrophobic Magnetite", 1991, 7/91 (aus Imm Extr. Metall. Conf., 5th, 1991), pp. 223-226.

Parsonage, P.; Warren Spring Lab, Stevenage, England, "The Recovery of Phosphate from Carbonaceous Gangue by Selective Magnetic Coating—A Novel Method of Mineral Separation by Control of Surface Properties", 1985, vol. 3, Published by Editions GEDIM, St. Etienne, pp. 347-356.

Wang, Y.; Forssberg, E.; Pugh, R.J.; Minerals Engineering, "Hydrophobic Magnetite Seeding of Hematite Ultrafines in High Gradient Magnetic Separation", vol. 6, No. 5, pp. 537-546, 1993.

* cited by examiner

*Primary Examiner* — David A Reifsnyder
(74) *Attorney, Agent, or Firm* — Melanie L. Brown

(57) ABSTRACT

The present invention relates to a process for separating at least one first material from a mixture comprising this at least one first material and at least one second material, which comprises the following steps:

(A) contacting of the mixture comprising at least one first material and at least one second material with at least one surface-active substance, if appropriate in the presence of at least one dispersant, resulting in the surface-active substance becoming attached to the at least one first material, (B) if appropriate, addition of at least one dispersant to the mixture obtained in step (A) to give a dispersion having a suitable concentration, (C) treatment of the dispersion from step (A) or (B) with at least one hydrophobic magnetic particle so that the at least one first material to which the at least one surface-active substance is bound and the at least one magnetic particle become attached to one another, (D) separation of the addition product from step (C) from the mixture by application of a magnetic field, (E) cleavage of the addition product which has been separated off in step (D) to obtain the at least one first material and the at least one magnetic particle separately.

8 Claims, No Drawings

PROCESSING RICH ORES USING MAGNETIC PARTICLES

PRIORITY

This patent application claims priority to pending patent application PCT/EP2008/061503 filed Sep. 1, 2008 claiming priority to European patent application 07115542.8 filed Sep. 3, 2007, both incorporated in their entireties by reference into this patent application.

DESCRIPTION

The present invention relates to a process for separating at least one first material from a mixture comprising this at least one first material and at least one second material, in which the first material is firstly brought into contact with a surface-active substance to hydrophobicize it, this mixture is then brought into contact with at least one magnetic particle so that the magnetic particle and the hydrophobicized first material become attached to one another and this agglomerate is separated from the at least one second material by application of a magnetic field and the at least one first material is subsequently separated, preferably quantitatively, from the magnetic particle, with the magnetic particle preferably being able to be recirculated to the process.

In particular, the present invention relates to a process for the enrichment of ores in the presence of the gangue.

Processes for separating ores from mixtures comprising these are already known from the prior art.

WO 02/0066168 A1 relates to a process for separating ores from mixtures comprising these, in which suspensions or slurries of these mixtures are treated with particles which are magnetic and/or capable of floating in aqueous solutions. After addition of the magnetic particles and/or particles capable of floating, a magnetic field is applied so that the agglomerates are separated off from the mixture. However, the extent to which the magnetic particles are bound to the ore and the strength of the bond is not sufficient for the process to be carried out with a satisfactorily high yield and effectiveness.

U.S. Pat. No. 4,657,666 discloses a process for the enrichment of ores, in which the ore present in the gangue is treated with magnetic particles, as a result of which agglomerates are formed due to the hydrophobic interactions. The magnetic particles are hydrophobicized on the surface by treatment with hydrophobic compounds, so that attachment to the ore occurs. The agglomerates are then separated off from the mixture by means of a magnetic field. The cited document also discloses that the ores are treated with a surface-activating solution of 1% sodium ethylxanthogenate before the magnetic particle is added. In this process, separation of ore and magnetic particle is effected by the destruction of the surface-activating substance which has been applied in the form of the surface-activating solution to the ore. Furthermore, in this process only $C_4$-hydrophobising agents are used for the ore.

U.S. Pat. No. 4,834,898 discloses a process for separating off nonmagnetic materials by bringing them into contact with magnetic reagents which are enveloped by two layers of surface-active substances. U.S. Pat. No. 4,834,898 also discloses that the surface charge of the nonmagnetic particles which are to be separated off can be influenced by various types and concentrations of electrolytes reagents. For example, the surface charge is altered by addition of multivalent anions, for example tripolyphosphate ions.

S. R. Gray, D. Landberg, N. B. Gray, Extractive Metallurgy Conference, Perth, 2-4 Oct. 1991, pages 223-226, disclose a process for recovering small gold particles by bringing the particles into contact with magnetite. Before contacting, the gold particles are treated with potassium amylxanthogenate. A process for separating the gold particles from at least one hydrophilic material is not disclosed in this document.

WO 2007/008322 A1 discloses a magnetic particle which is hydrophobicized on the surface for separating impurities from mineral substances by magnetic separation processes. According to WO 2007/008322 A1, a dispersant selected from among sodium silicate, sodium polyacrylate and sodium hexametaphosphate can be added to the solution or dispersion.

It is an object of the present invention to provide a process by means of which at least one first material can be efficiently separated from mixtures comprising at least one first material and at least one second material. A further object of the present invention is to treat the first particles to be separated off in such a way that the addition product of magnetic particle and first material is sufficiently stable to ensure a high yield of the first material in the separation.

These objects are achieved by a process for separating at least one first material from a mixture comprising this at least one first material and at least one second material, which comprises the following steps:

(A) contacting of the mixture comprising at least one first material and at least one second material with at least one surface-active substance, if appropriate in the presence of at least one dispersant, resulting in the surface-active substance becoming attached to the at least one first material, (B) if appropriate, addition of at least one dispersant to the mixture obtained in step (A) to give a dispersion having a suitable concentration, (C) treatment of the dispersion from step (A) or (B) with at least one hydrophobic magnetic particle so that the at least one first material to which the at least one surface-active substance is bound and the at least one magnetic particle become attached to one another, (D) separation of the addition product from step (C) from the mixture by application of a magnetic field, (E) cleavage of the addition product which has been separated off in step (D) to obtain the at least one first material and the at least one magnetic particle separately.

The process of the invention is preferably employed for separating at least one first, hydrophobic material from a mixture comprising this at least one first, hydrophobic material and at least one second, hydrophilic material.

For the purposes of the present invention, "hydrophobic" means that the corresponding particle can subsequently be hydrophobicized by treatment with the at least one surface-active substance. It is also possible for a particle which is hydrophobic per se to be additionally hydrophobicized by treatment with the at least one surface-active substance.

Within the scope of the present invention, "hydrophobic" means that the surface of corresponding "hydrophobic substances", and, respectively, of a "hydrophobicized substance" has a contact angle with water against air of >90°. In the scope of the present invention, "hydrophilic" means that the surface of corresponding "hydrophilic substance" has a contact angle with water against air of <90°.

In a preferred embodiment of the process of the invention, the at least one first material is at least one hydrophobic metal compound or coal and the at least one second material is preferably at least one hydrophilic metal compound.

Thus, the at least one first material to be separated off is preferably a metal compound selected from the group consisting of sufidic ores, oxidic and/or carbonate-comprising ores, for example azurite $[Cu_3(CO_3)_2(OH)_2]$ or malachite $[Cu_2[(OH)_2|CO_3]]$, and the noble metals and their compounds to which a surface-active compound can become selectively attached to produce hydrophobic surface properties.

The at least one hydrophilic metal compound is preferably selected from the group consisting of oxidic and hydroxidic metal compounds, for example silicon dioxide $SiO_2$, silicates, aluminosilicates, for example feldspars, for example albite $Na(Si_3Al)O_9$, mica, for example muscovite $KAl_2[(OH,F)_2AlSi_3O_{10}]$, Garnets $(Mg, Ca, Fe^{II})_3(Al, Fe^{III})_2(SiO_4)_3$, $Al_2O_3$, $FeO(OH)$, $FeCO_3$, $Fe_2O_3$, $Fe_3O_4$ and further related minerals and mixtures thereof.

Examples of sulfidic ores which can be used according to the invention are, for example, selected from the group of copper ores consisting of covellite CuS, molybdenum(IV) sulfide, chalcopyrite (cupriferous pyrite) $CuFeS_2$, bornite $Cu_5FeS_4$, chalcocite (copper glass) $Cu_2S$ and mixtures thereof.

Suitable oxidic metal compounds which can be used according to the invention are preferably selected from the group consisting of silicon dioxide $SiO_2$, silicates, aluminosilicates, for example feldspars, for example albite $Na(Si_3Al)O_8$, mica, for example muscovite $KAl_2[(OH,F)_2AlSi_3O_{10}]$, garnets $(Mg, Ca, Fe^{II})_3(Al, Fe^{III})_2(SiO_4)_3$ and further related minerals and mixtures thereof.

Accordingly, untreated ore mixtures obtained from mines are preferably used in the process of the invention.

In a preferred embodiment of the process of the invention, the mixture comprising at least one first material and at least one second material in step (A) is in the form of particles having a size of from 100 nm to 100 μm, see, for example U.S. Pat. No. 5,051,199. In a preferred embodiment, this particle size is obtained by milling. Suitable processes and apparatuses are known to those skilled in the art, for example wet milling in a ball mill. The mixture comprising at least one first material and at least one second material is therefore milled to particles having a size of from 100 nm to 100 μm before or during step (A) in a preferred embodiment of the process of the invention. Preferred ore mixtures have a content of sulfidic minerals of at least 0.4% by weight, particularly preferably at least 10% by weight.

Example of sulfidic minerals which are present in the mixtures which can be used according to the invention are those mentioned above. In addition, sulfide of metals other than copper, for example, sulfides of iron, lead, zinc or molybdenum, i.e. $FeS/FeS_2$, PbS, ZnS or $MoS_2$, can also be present in the mixtures. Furthermore, oxidic compounds of metals and semimetals, for example silicates or borates or other salts of metals and semimetals, for example phosphates, sulfates or oxides/hydroxides/carbonates, and further salts, for example azurite $[Cu_3(CO_3)_2(OH)_2]$, malachite $[Cu_2[(OH)_2(CO_3)]]$, barite $(BaSO_4)$, monazite $((La\text{-}Lu)PO_4)$, can be present in the ore mixtures to be treated according to the invention. Further examples of the at least one first material which is separated off by the process of the invention are noble metals, for example Au, Pt, Pd, Rh, etc., preferably in the native state.

A typical ore mixture which can be separated by means of the process of the invention has the following composition: about 30% by weight of $SiO_2$, about 10% by weight of $Na(Si_3Al)O_8$, about 3% by weight of $Cu_2S$, about 1% by weight of $MoS_2$, balance chromium, iron, titanium and magnesium oxides.

The individual steps of the process of the invention are described in detail below:

Step (A):

Step (A) of the process of the invention comprises contacting of the mixture comprising at least one first material and at least second material with at least one surface-active substance, if appropriate in the presence of at least one dispersant, resulting in the surface-active substance becoming attached to the at least one first material.

Suitable preferred first and second materials have been mentioned above.

For the purposes of the present invention, a "surface-active substance" is a substance which is able to alter the surface of the particle to be separated off in the presence of the other particles which are not to be separated off in such a way that attachment of a hydrophobic particle by means of hydrophobic interactions occurs. Surface-active substances which can be used according to the invention become attached to the at least one first material and thereby produce a suitable hydrophobicity of the first material.

In the process of the invention, preference is given to using a surface-active substance of the general formula (I)

$$A\text{-}Z \qquad (I)$$

which becomes attached to the at least one first material, where

A is selected from among linear or branched $C_3$-$C_{30}$-alkyl, $C_3$-$C_{30}$-heteroalkyl, optionally substituted $C_6$-$C_{30}$-aryl, optionally substituted $C_6$-$C_{30}$-heteroalkyl, $C_6$-$C_{30}$-aralkyl, and Z is a group by means of which the compound of the general formula (I) binds to the at least one hydrophobic material.

In a particularly preferred embodiment, A is a linear or branched $C_4$-$C_{12}$-alkyl, very particularly preferably a linear $C_4$- or $C_8$-alkyl. Heteroatoms which may be present according to the invention are selected from among N, O, P, S and halogens such as F, Cl, Br and I.

In a further preferred embodiment, A is preferably a linear or branched, preferably linear, $C_8$-$C_{20}$-alkyl. Furthermore, A is preferably a branched $C_6$-$C_{14}$-alkyl, wherein the at least one substituent, preferably having 1 to 6 carbon atoms, is preferably attached in 2-position, for example 2-ethylhexyl and/or 2-propylheptyl.

In a further particularly preferred embodiment, X is selected from the group consisting of anionic groups $—(X)_n—PO_3^{2-}$, $—(X)_n—PO_2S^{2-}$, $—(X)_n—POS_2^{2-}$, $—(X)_n—PS_3^{2-}$ $—(X)_n—PS_2^{-}$, $—(X)_n—POS^{-}$, $—(X)_n—PO_3^{2-}$, $—(X)_n—PO_3^{2-}$ $—(X)_n—CO_2^{-}$, $—(X)_n—CS_2^{-}$, $—(X)_n—COS^{-}$, $—(X)_n—C(S)NHOH$, $—(X)_n—S^{-}$ where X is selected from the group consisting of O, S, NH, $CH_2$ and n=0, 1 or 2, with, if appropriate, cations selected from the group consisting of hydrogen, $NR_4^+$ where the radicals R are each, independently of one another, hydrogen or $C_1$-$C_8$-alkyl, an alkali metal or an alkaline earth metal. The anions mentioned and the corresponding cations form, according to the invention, uncharged compounds of the general formula (I).

If, in the mentioned formulas n=2, two equal or different, preferably equal, groups A are attached to one group Z.

In a further preferred embodiment, compounds are applied, chosen from the group consisting of xanthates $A\text{-}O—CS_2^{-}$, dialkyldithiophosphates $(A\text{-}O)_2—PS_2^{-}$, dialkyldithiophosphinates $(A)_2\text{-}PS_2^{-}$ and mixtures thereof, wherein A independently of one another is a linear or branched, preferably linear, $C_6$-$C_{20}$-alkyl, for example n-octyl, or a branched $C_6$-$C_{14}$-alkyl, wherein the branch is preferably located in 2-position, for example 2-ethylhexyl and/or 2-propylheptyl. As counterions, in these compounds preferably cations chosen from the group consisting of hydrogen, $NR_4^+$ with R being independently of one another hydrogen and/or $C_1$-$C_8$-alkyl, alkali- or earth alkali metals, preferably sodium or potassium, are present.

Exceptionally preferred compounds of general formula (I) are chosen from the group consisting of sodium- or potassium-n-octylxanthate, sodium- or potassium-butylxanthate, sodium- or potassium-di-n-octyldithiophosphinate, sodium- or potassium-di-n-octyldithiophosphate and mixtures of these compounds.

In the case of noble metals, for example Au, Pd, Rh, etc., particularly preferred surface-active substances are monothiols, dithiols and trithiols, or 8-hydroxyquinolines, for example as described in EP 1200408 B1.

In the case of metal oxides, for example FeO(OH), $Fe_3O_4$, ZnO, etc., carbonates, for example azurite $[Cu(CO_3)_2(OH)_2]$, malachite $[Cu_2[(OH)_2CO_3]]$, particularly preferred surface-active substances are octylphosphonic acid (OPS), $(EtO)_3Si$-A, $(MeO)_3Si$-A, with the abovementioned meanings of A. In a preferred embodiment of the process of the invention, no hydroxamates are used as surface-active substances for modifying metal oxides.

In the case of metal sulfides, for example $Cu_2S$, $MoS_2$, etc., particularly preferred surface-active substances are monothiols, dithiols and trithiols or xanthogenates.

In a further preferred embodiment of the process of the invention, Z is $—(X)_n—CS_2^-$, $—(X)_n—PO_2^-$ or $—(X)_n—S^-$ where X is O and n is 0 or 1, and a cation is selected from among hydrogen, sodium and potassium. Very particularly preferred surface-active substances are 1-octanethiol, potassium n-octyl-xanthate, potassium-butylxanthate, octylphosphonic acid and the compound of the formula (IV)

(IV)

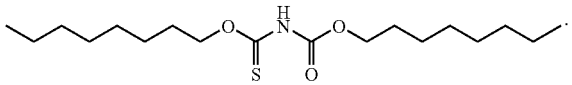

The contacting in step (A) of the process of the invention can be brought about by all methods known to those skilled in the art. Step (A) can be carried out in bulk or in dispersion, preferably in suspension, particularly preferably in aqueous suspension.

In an embodiment of the process of the invention, step (A) is carried out in bulk, i.e. in the absence of a dispersion medium.

For example, the mixture to be treated and the at least one surface-active substance are combined and mixed in the appropriate amounts without a further dispersion medium. Suitable mixing apparatuses are known to those skilled in the art, for example mills such as ball mills.

In a further preferred embodiment, step (A) is carried out in a dispersion, preferably in suspension. Suitable dispersion media are all dispersion media in which the mixture from step (A) is not completely soluble. Suitable dispersion media for producing the slurry or dispersion as per step (B) of the process of the invention are selected from the group consisting of water, water-soluble organic compounds, for example alcohols having from 1 to 4 carbon atoms, and mixtures thereof.

In a particularly preferred embodiment, the dispersion medium in step (A) is water.

Step (A) of the process of the invention is generally carried out at a temperature of from 1 to 80° C., preferably from 20 to 40° C., particularly preferably at ambient temperature.

The at least one surface-active substance is generally used in an amount which is sufficient to achieve the desired effect. In a preferred embodiment, the at least one surface-active substance is added in an amount of from 0.01 to 5% by weight, in each case based on the total mixture to be treated.

Step (B):

The optional step (B) of the process of the invention comprises addition of at least one dispersion medium to the mixture obtained in step (A) in order to obtain a dispersion.

In one embodiment, if step (A) is carried out in bulk, the mixture obtained in step (A) comprises at least one first material and at least second material which has been modified on the surface by at least one surface-active substance. If step (A) is carried out in bulk, step (B) of the process of the invention is carried out, i.e. at least one suitable dispersion medium is added to the mixture obtained in step (A) in order to obtain a dispersion.

In the embodiment in which step (A) of the process of the invention is carried out in dispersion, step (B) is not carried out. However, in this embodiment, too, it is possible to carry out step (B), i.e. to add further dispersion medium in order to obtain a dispersion having a lower concentration.

Suitable dispersion media are all dispersion media which have been mentioned above in respect of step (A). In a particularly preferred embodiment, the dispersion medium in step (A) is water.

Thus, step (B) comprises either converting the mixture present in bulk from step (A) into a dispersion or converting the mixture which is already in dispersion from step (A) into a dispersion of lower concentration by addition of dispersion media.

According to the invention, the amount of dispersion medium added in step (A) and/or step (B) can generally be selected so that a dispersion which is readily stirrable and/or conveyable is obtained. In a preferred embodiment, the amount of mixture to be treated based on the total slurry or dispersion is up to 100% by weight, particularly preferably from 0.5 to 10% by weight.

In a preferred embodiment of the process of the invention, step (B) is not carried out but instead step (A) is carried out in aqueous dispersion so that a mixture in aqueous dispersion having the correct concentration for use in step (C) of the process of the invention is obtained directly in step (A).

The addition of dispersion medium in step (B) of the process of the invention can, according to the invention, be carried out by all methods known to those skilled in the art.

Step (C):

Step (C) of the process of the invention comprises treatment of the dispersion from step (A) or (B) with at least one hydrophobic magnetic particle so that the at least one first material to which the at least one surface-active substance is bound and the at least one magnetic particle become attached to one another.

In step (C) of the process of the invention, it is possible to use all magnetic substances and materials known to those skilled in the art. In a preferred embodiment, the at least one magnetic particle is selected from the group consisting of magnetic metals, for example irons, cobalt, nickel and mixtures thereof, ferromagnetic alloys of magnetic metals, for example NdFeB, SmCo and mixtures thereof, magnetic iron oxides, for example magnetite, magnetic hematite, cubic ferrites of the general formula (II)

$$M^{2+}_xFe^{2+}_{1-x}Fe^{3+}_2O_4 \quad (II)$$

where

M is selected from among Co, Ni, Mn, Zn and mixtures thereof and x is $\leqq 1$, hexagonal ferrites, for example barium or strontium ferrite $MFe_6O_{19}$ where M=Ca, Sr, Ba, or a mixture thereof. The magnetic particles can additionally have an outer layer, for example of $SiO_2$.

In a particularly preferred embodiment of the present invention, the at least one magnetic particle is magnetite or cobalt ferrite $Co^{2+}{}_xFe^{2+}{}_{1-x}Fe^{3+}{}_2O_4$ where $x \leqq 1$.

In a further preferred embodiment, in step (C) of the process according to the present invention, magnetic particles are present in the size of 100 nm to 100 μm, particularly preferred 1 to 50 μm. The magnetic particles may be brought into the adequate size by processes known to the skilled artisan, for example by milling. Furthermore, the particles, obtained from precipitation reaction, can be brought to the adequate particle size by setting up the reaction parameters (for example pH, reaction time, temperature).

In a further preferred embodiment, the at least one magnetic particle is hydrophobicized on the surface by at least one hydrophobic compound. The hydrophobic compound is preferably selected from among compounds of the general formula (III)

$$B—Y \qquad (III),$$

where

B is selected from among linear or branched $C_3$-$C_{30}$-alkyl, $C_3$-$C_{30}$-heteroalkyl, optionally substituted $C_6$-$C_{30}$-aryl, optionally substituted $C_6$-$C_{30}$-heteroalkyl, $C_6$-$C_{30}$-aralkyl, and Y is a group by means of which the compound of the general formula (III) binds to the at least one magnetic particle.

In a particularly preferred embodiment, B is a linear or branched $C_6$-$C_{18}$-alkyl, preferably linear $C_8$-$C_{12}$-alkyl, very particularly preferably a linear $C_{12}$-alkyl. Heteroatoms which may be present according to the invention are selected from among N, O, P, S and halogens such as F, Cl, Br and I.

In a further particularly preferred embodiment, Y is selected from the group consisting of $—(X)_n—SiHal_3$, $—(X)_n—SiHHal_2$, $—(X)_n—SiH_2Hal$ where Hal is F, Cl, Br, I, and anionic groups such as $—(X)_n—SiO_3^{3-}$, $—(X)_n—CO_2^-$, $—(X)_n—PO_3^{2-}$, $—(X)_n—PO_2S^{2-}$, $—(X)_n—POS_2^{2-}$, $—(X)_n—PS_3^{2-}$, $—(X)_n—PS_2^-$, $—(X)_n—POS^-$, $—(X)_n—PO_2^-$, $—(X)_n—CO_2^-$, $—(X)_n—CS_2^-$, $—(X)_n—COS^-$, $—(X)_n—C(S)NHOH$, $—(X)_n—S^-$ where X=O, S, NH, $CH_2$ and n=0, 1 or 2, and, if appropriate, cations selected from the group consisting of hydrogen, $NR_4^+$ where the radicals R are each, independently of one another, hydrogen or $C_1$-$C_8$-alkyl, an alkali metal, an alkaline earth metal or zinc, also $—(X)_n—Si(OZ)_3$ where n=0, 1 or 2 and Z=charge, hydrogen or short-chain alkyl radical.

If, in the mentioned formulas n=2, two equal or different, preferably equal, groups B are attached to one group Y.

Very preferred hydrophobicizing substances of general formula (III) are alkyltrichlorosilane (alkyl group having 6 to 12 carbon atoms), alkyltrimethoxysilane (alkyl group having 6 to 12 carbon atoms), octylphosphonic acid, lauric acid, oleic acid, stearic acid or mixtures thereof.

The treatment of the solution or dispersion with at least one hydrophobic magnetic particle in step (C) of the process of the invention can be carried out by all methods known to those skilled in the art.

In a preferred embodiment, the at least one magnetic particle is dispersed in a suitable dispersion medium.

Suitable dispersion media are all dispersion media in which the at least one magnetic particle is not completely soluble. Suitable dispersion media for dispersion as per step (C) of the process of the invention are selected from the group consisting of water, water-soluble organic compounds and mixtures thereof, particularly preferably water. Particular preference is given to using the same dispersion medium in step (C) as in step (B).

According to the invention, the amount of dispersion medium for predispersing the magnetic particles can generally be selected so that a slurry or dispersion which is readily stirrable and/or conveyable is obtained. In a preferred embodiment, the amount of mixture to be treated based on the total slurry or dispersion is up to 60% by weight.

According to the invention, the dispersion of the magnetic particles can be produced by all methods known to those skilled in the art. In a preferred embodiment, the magnetic particles to be dispersed and the appropriate amount of dispersion medium or mixture of dispersion media are combined in a suitable reactor, for example a glass reactor, and stirred by means of devices known to those skilled in the art, for example in a glass tank by means of a magnetically operated propeller stirrer, for example at a temperature of from 1 to 80° C., preferably at room temperature.

The treatment of the dispersion from step (B) with at least one hydrophobic magnetic particle is generally carried out by combining the two components by methods known to those skilled in the art. In a preferred embodiment, a dispersion of the at least one magnetic particle is added to the mixture which has previously been treated with at least one surface-active substance. In a further embodiment, the magnetic particle in solid form can be added to a dispersion of the mixture to be treated. In a further preferred embodiment, both components are present in dispersed form.

Step (C) is generally carried out at a temperature of from 1 to 80° C., preferably from 10 to 30° C.

In step (C), the at least one magnetic particle becomes attached to the hydrophobic material of the mixture to be treated. The bond between the two components is based on hydrophobic interactions. There is generally no bonding interaction between the at least one magnetic particle and the hydrophilic component of the mixture, so that these components do not become attached to one another. Thus, addition products of the at least one hydrophobic material and the at least one magnetic particle are present alongside the at least one hydrophilic material in the mixture after step (C).

Step (D):

Step (D) of the process of the invention comprises separation of the addition product from step (C) from the mixture by application of a magnetic field.

Step (D) can, in a preferred embodiment, be carried out by introducing a permanent magnet into the reactor in which the mixture from step (C) is present. In a preferred embodiment, a dividing wall composed of nonmagnetic material, for example the glass wall of the reactor, is present between permanent magnet and mixture to be treated. In a further preferred embodiment of the process of the invention, an electromagnet which is only magnetic when an electric current flows is used in step (D). Suitable apparatuses are known to those skilled in the art.

Step (D) of the process of the invention can be carried out at any suitable temperature, for example from 10 to 60° C.

During step (D), the mixture is preferably continuously stirred by means of a suitable stirrer, for example a Teflon stirrer bar or a propeller stirrer.

In step (D), the addition product from step (C) can, if appropriate, be separated off by all methods known to those skilled in the art, for example by draining the liquid together with the hydrophilic component of the suspension from the reactor used for step (D) via the bottom valve or pumping the components of the suspension which are not held back by the at least one magnet away through a hose.

Step (E):

Step (E) of the process of the invention comprises cleavage of the addition product which has been separated off in step (D) to obtain the at least one first material and the at least one magnetic particle separately. In a preferred embodiment of the process of the invention, the cleavage in step (E) is carried out in a nondestructive manner, i.e. the individual components present in the dispersion are not changed chemically. For example, the cleavage according to the invention is not effected by oxidation of the hydrophobicizing agent, for example to give the oxidation products or degradation products of the hydrophobicizing agent.

Cleavage can be carried out by all methods known to those skilled in the art which are suitable for cleaving the addition product in such a way that the at least one magnetic particle can be recovered in reusable form. In a preferred embodiment, the magnetic particle which has been cleaved off is reused in step (C).

In a preferred embodiment, the cleavage in step (E) of the process of the invention is effected by treatment of the addition product with a substance selected from the group consisting of organic solvents, basic compounds, acidic compounds, oxidants, reducing agents, surface-active compounds and mixtures thereof.

Examples of suitable organic solvents are methanol, ethanol, propanol, for example n-propanol or isopropanol, aromatic solvents, for example benzene, toluene, xylenes, ethers, for example diethyl ether, methyl t-butyl ether, ketones, for example acetone, aromatic or aliphatic hydrocarbons, for example saturated hydrocarbons with for example 6 to 10 carbon atoms, for example dodecane and/or Schellsole, Diesel fuel and mixtures thereof. The main components of Diesel fuel are predominantly alkanes, cycloalkanes and aromatic hydrocarbons having about 9 to 22 carbon atoms per molecule and a boiling range between 170° C. and 390° C.

Examples of basic compounds which can be used according to the invention are aqueous solutions of basic compounds, for example aqueous solutions of alkali metal and/or alkaline earth metal hydroxides, for example KOH, NaOH, lime water, aqueous ammonia solutions, aqueous solutions of organic amines of the general formula $R^2{}_3N$, where the radicals $R^2$ are selected independently from the group consisting of $C_1$-$C_8$-alkyl which may optionally be substituted by further functional groups. In a preferred embodiment, step (D) is carried out by addition of aqueous NaOH solution to a pH of 13, for example in order to separate off $Cu_2S$ modified with OPA. The acidic compounds can be mineral acids, for example HCl, $H_2SO_4$, $HNO_3$ or mixtures thereof, organic acids, for example carboxylic acids. As oxidants, it is possible to use $H_2O_2$, for example as 30% strength by weight aqueous solution (Perhydrol). The separation of $Cu_2S$ modified with thiols is preferably carried out using $H_2O_2$ or $Na_2S_2O_4$.

Examples of surface-active compounds which can be used according to the invention are nonionic, anionic, cationic and/or zwitterionic surfactants.

In a preferred embodiment, the addition product of hydrophobic material and magnetic particle is cleaved by means of an organic solvent, particularly preferably acetone and/or and/or Diesel fuel. This process can also be aided mechanically. In a preferred embodiment, ultrasound is used for aiding the cleavage process.

In general, the organic solvent is used in an amount which is sufficient to cleave virtually all of the addition products. In a preferred embodiment, from 20 to 100 ml of organic solvent are used per gram of addition product of hydrophobic material and magnetic particle to be cleaved.

After cleavage, the at least one first material and the at least one magnetic particle are, according to the invention, present as dispersion in the abovementioned cleavage reagent, preferably an organic solvent.

The at least one magnetic particle is separated from the dispersion comprising this at least one magnetic particle and the at least one first material by means of a permanent magnet or electromagnet. Details of the separation are analogous to step (D) of the process of the invention.

The first material to be separated off, preferably the metal compound to be separated off, is preferably separated from the organic solvent by distilling off the organic solvent. The first material which can be obtained in this way can be purified by further processes known to those skilled in the art. The solvent can, if appropriate after purification, be recirculated to the process of the invention.

EXAMPLES

Example 1

A mixture of 10.0 g of sea sand (Bernd Kraft GmbH; purified by means of hydrochloric acid; batch 1046306), 2.02 g of $Cu_2S$ (powder, 325 mesh; Aldrich Lot 01516LD-416) and 1.7% by weight of 1-octanethiol (98% pure, analytical reagent from Merck; batch S20709716) is milled in a planetary ball mill (500 ml agate container containing 50 agate balls (ø=10 mm) at 200 rpm for 30 minutes. The mixture is subsequently dried at 50° C. in a vacuum drying oven (p<100 mbar) for 16 hours.

This mixture is introduced together with 1.506 g of magnetite which has been modified by means of dodecyltrichlorosilane (primary particle size: about 10 nm) into a 1 l stirred apparatus, admixed with 580 ml of water and 0.1 g of dodecylamine (Alfa Aeser Lot: 10108955) and mixed by means of a Teflon stirrer bar at 150 rpm for 45 minutes. A Co—Sm magnet (height: 5 cm, length: 2 cm, width: 2 cm) is subsequently held against an exterior wall of the stirred apparatus and stirring is continued at 150 rpm for a further 30 minutes. The water is then removed via a hose and the apparatus is dried by means of a hot air blower for another 10 minutes. The sand present on the bottom is reweighed and found to weigh 9.77 g. The residue held back by the magnet weighs 1.76 g (87% of the $Cu_2S$ used).

The tank is subsequently filled with 400 ml of acetone and stirred at 200 rpm for 30 minutes. The acetone in which the $Cu_2S$ is present as fine particles is then drained via a hose and dried. A weight of 1.59 g is obtained (79% $Cu_2S$).

Example 2

A sand/$Cu_2S$ mixture analogous to that in example 1 is produced. However, potassium butylxanthate is used in place of 1-octanethiol. The further experimental procedure is analogous to example 1. The amount of sand on the bottom is 9.64 g, and the residue held back by the magnet weighs 1.61 g (80.0% $Cu_2S$). After the process of separating magnetic particles and or by stirring in acetone, 1.44 g of $Cu_2S$ (71%) are obtained.

Example 3

A mixture of 1.00 g of $Cu_2S$ (Fluka, 99%) and 28.00 g of silica (Euroquarz, Microsil grade S8) is milled together with 0.03 g of octylphosphonic acid (Rhodia; 80%) in 30 ml of water for 1 hour. At the same time, 3.00 g of magnetite (Magnetpigment S0045, BASF, $d_{50}$=2 μm) is stirred with a suspension of 0.015 g of octylphosphonic acid in 15 ml of water for 1 hour. The two suspensions are mixed with one another in 500 ml of water, stirred for 1 hour and magnetically separated. The silica content held back by the magnet is 0.5% by weight. The set-up is subsequently flooded with 0.1 M NaOH solution, shaken gently and the liquid is subsequently discharged. After drying, 60% of the $Cu_2S$ are recovered.

Example 4

0.5 g of Pd-coated ZnO is dispersed in 10 ml of deionized water, resulting in the solution becoming gray. 0.5 g of thiol-modified $Fe_3O_4$ is subsequently added and the mixture is stirred vigorously. After 1 hour, a Co/Sm magnet is held against the exterior wall of the vessel, resulting in the solution becoming very largely clear. The supernatant solution is decanted off from the magnetic constituents and the volatile constituents are removed under reduced pressure. 0.1 g of Pd-coated ZnO is recovered, i.e. the remainder of the ZnO is separated magnetically from the mixture.

Example 5

1.00 g of palladium powder is mixed with 1.7% by weight of octanethiol in a ball mill and added to 50 ml of deionized water. 4.00 g of hydrophobicized $Fe_3O_4$ are subsequently added and the system is shaken 3 times for 15 minutes. A Co—Sm magnet is subsequently held against one side of the reaction vessel. The water is decanted off, with the magnet hold the solid constituents on the glass wall. 0.11 g of palladium is isolated from the supernatant solution. The remainder (0.89 g, corresponding to 89%) has accordingly been separated magnetically from the solution and collected at the magnet.

Example 6

1 g $Cu_2S$ (−325 mesh, Fa. Aldrich) are stirred with 0.065 g potassium-n-octylxanthate in 50 mL water for 30 minutes. Subsequently, 3 g magnetite being modified with octylphosphonic acid and further 100 mL. water are added. After one hour, the water is discharged, and for one minute, compressed air is run across the solid. Afterwards, 500 mL Diesel fuel ("Super Diesel-fuel") are added and the reaction mixture is strongly mixed, followed by treating for 10 minutes in an ultrasonic bath. The Diesel fuel phase is subsequently decanted over a magnet, so that the magnetic components are held off. The Diesel fuel phase comprising the unmagnetic components is subjected to a filtration, and subsequently, the solid is dried. 0.98 g solid are recovered, consisting of $Cu_2S$ in an amount of 98%. The amount of $Fe_3O_4$ is less than 0.01 g. This experiment is repeated 3 times, wherein only magnetite from the first separation cycle is used. The tar weight of $Cu_2S$ corresponds to 0.87 g (concentration of $Cu_2S$ 88%), 0.99 g (concentration of $Cu_2S$ 87%), 0.93 g (concentration of $Cu_2S$ 95%). In no case, a concentration of $Fe_3O_4$ of more than 0.01 g is detected.

Example 7

Handling of Natural Copper Ore from Pelampres (Chile)

Starting concentration of the ore that has to be treated: Co 0.54% by weight, Mo 0.029% by weight Pretreatment of Ore The ore is aridly milled in a hammer mill prior to the separation experiments, until 90% by weight of the ore is present in a fraction having a size of less than 125 μm.

Hydrophobicized Magnetite:

Magnetic pigments 354 (BASF SE), are treated with 0.5% by weight octylphosphonic acid in aqueous solution for 30 minutes at room temperature (RT). The solid is removed by filtration, until a conductivity of about 50 μS is obtained, washed with hot water (50° C.) and dried at 80° C. in vacuum.

Separation Procedure:

1 L material to be separated is channelled across a chain of stationary permanent magnets. The discharge obtained is collected as fraction A1. The fraction which is present at the magnets is washed with one L water during move wing of the magnets, wherein the discharged solid is collected as fraction A2. The fraction R which is further present at the magnets, and fractions A1 and A2, are analyzed in respect of Co-, Fe- and Mo-concentration.

Example 7.1

100 g ore are conditioned in a swing mill (160 mL $ZrO_2$ sphericals, diameter 1.7 to 2.7 mm) with 60 mL water, 0.065 g potassium-n-octylxanthate and 0.04 g Shelisol® D40 in 5 minutes. Subsequently, a suspension of 3 g hydrophobicized magnetite in 3 g iso-propanol is added to the milling vessel and further conditioned for 5 minutes. The milling suspension is separated from the grinding bodies, diluted to 1 L and subjected to the separation procedure (see above). Fraction R (6.4 g) comprises the total amount of magnetite and 92.4% of copper and 86.1% of molybdenum.

Example 7.2

100 g ore are suspended in 900 mL water, in a stirring vessel, equipped with a propeller stirrer. A solution of 0.065 g potassium-di-n-octyldithiophosphinate and 100 mL water and 0.04 mL Shellsol® are added under stirring and the ore is conditioned for one hour under steering. Subsequently, suspension of 3 g hydrophobicized magnetite in 3 g iso-propanol is added and stirred for further 30 minutes. Subsequently, it is subjected to the separation procedure as described above. Fraction R (8.97 g) comprises the whole magnetite which has been applied, and 85.8% of the copper and 82.3% of the molybdenum.

Example 7.3

100 g ore are conditioned with 60 mL water, 0.065 g potassium-di-n-octyldithiophosphinate and 0.04 g Shellsol® D40 over 5 minutes in a swing mill (160 mL $ZrO_2$ sphericals, diameter 1.7 to 2.7 nm). Subsequently, a suspension of 3 g hydrophobised magnetite in 3 g isopropanol is added to the grinding vessel and conditioned for further 5 minutes. The grinding suspension is separated from their grinding bodies, diluted to 1 L and subjected to the separation procedure, see above. Fraction R (6.9 g) comprises the whole applied magnetite and 94.7% of the copper and 83.2% of the molybdenum. The fraction consists of chalcopyrite (from XRD data) in an amount 35%.

The invention claimed is:

1. A process for separating at least one first material from a mixture comprising this at least one first material and at least one second material, which comprises the following steps:

(A) contacting of the mixture comprising at least one first material and at least one second material with at least one surface-active substance, if appropriate in the presence of at least one dispersant, resulting in the surface-active substance becoming attached to the at least one first material, (B) if appropriate, addition of at least one dispersant to the mixture obtained in step (A) to give a dispersion having a suitable concentration, (C) treatment of the dispersion from step (A) or (B) with at least one hydrophobic magnetic particle so that the at least one first material to which the at least one surface-active substance is bound and the at least one magnetic particle become attached to one another, (D) separation of the addition product from step (C) from the mixture by application of a magnetic field, (E) cleavage of the addition product which has been separated off in step (D) to obtain the at least one first material and the at least one magnetic particle separately, wherein the surface active agent is a substance of the general formula (I)

$$A\text{-}Z \qquad (I)$$

where

A is selected among linear or branched $C_3$-$C_{30}$-alkyl, $C_3$-$C_{30}$-heteroalkyl, optionally substituted $C_6$-$C_{30}$-heteroalkyl, $C_6$-$C_{30}$-aralkyl, and Z is a group by means of which the compound of the general formula (I) binds to the at least one hydrophobic material.

2. The process according to claim 1, wherein the first material is a hydrophobic metal compound or coal and the second material is a hydrophilic metal compound.

3. The process according to claim 1, wherein the Z is selected from the group consisting of anionic groups $—(X)_n—PO_3^{2-}$, $—(X)_n—PO_2S^{2-}$, $—(X)_n—POS^{2-}$, $—(X)_n—PS_3^{2-}$, $—(X)_n—PS_2^-$, $—(X)_n—POS^-$, $—(X)_n—PO_2^-$, $—(X)_n—PO_3^{2-}$, $—(X)_n—CO_2^-$, $—(X)_n—CS_2^-$, $—(X)_n—COS^-$, $—(X)_n—CO(S)NHOH$, $—(X)_n—S^-$ where X is selected from the group consisting of O, S, NH, $CH_2$ and n=0, 1 or 2, with, if appropriate, cations selected from the group consisting of hydrogen, $NR_4^+$ where the radicals R are each, independently of one another, hydrogen or $c_1$-$c_8$-alkyl, an alkali metal or an alkaline earth metal.

4. The process according to claim 1, wherein the at least one hydrophobic metal compounds is selected from the group consisting of sulfidic ores, oxidic ores and carbonate-comprising ores.

5. The process according to claim 1, wherein the at least one hydrophilic metal compound is selected from the group consisting of oxidic and hydroxidic metal compounds.

6. The process according to claim 1, wherein the at least one magnetic particle is selected from the group consisting of magnetic metals, for example irons, cobalt, nickel and mixtures thereof, ferromagnetic alloys of magnetic metals, for example NdFeB, SmCo and mixtures thereof, magnetic iron oxides, for example magnetite, magnetic hematite, cubic ferrites of the general formula (II)

$$M^{2+}{}_xFe^{2+}{}_{1-x}Fe^{3+}{}_2O_4 \qquad (II)$$

where

M is selected from among Co, Ni, Mn, Zn and mixtures thereof and x is $\leqq 1$ hexagonal ferrites and mixtures thereof.

7. The process according to claim 1, wherein the dispersion medium is water.

8. The process according to any of claim 1 , wherein the mixture comprising at least one first material and at least one second material is milled to particles having a size of from 100 nm to 100 μm before or during step (A).

* * * * *